US008776280B2

(12) United States Patent
Baranj et al.

(10) Patent No.: US 8,776,280 B2
(45) Date of Patent: Jul. 15, 2014

(54) TOILET OVERFLOW PAN

(76) Inventors: Robert Baranj, Pitt Meadows (CA); Bentley Dennis Dale, Pitt Meadows (CA)

( * ) Notice: Subject to any disclaimer, the term of this patent is extended or adjusted under 35 U.S.C. 154(b) by 257 days.

(21) Appl. No.: 13/473,923

(22) Filed: May 17, 2012

(65) Prior Publication Data

US 2013/0305443 A1 Nov. 21, 2013

(51) Int. Cl.
*E03D 11/00* (2006.01)

(52) U.S. Cl.
USPC ..... 4/251.1

(58) Field of Classification Search
USPC ..... 4/251.1
See application file for complete search history.

(56) References Cited

U.S. PATENT DOCUMENTS

| | | | | |
|---|---|---|---|---|
| 2,229,814 | A * | 1/1941 | Mikolajczak et al. | 4/252.5 |
| 2,499,115 | A | 1/1947 | Shobe | |
| 5,608,922 | A * | 3/1997 | Lewis | 4/251.1 |
| 6,269,495 | B1 | 8/2001 | Sondrup | |
| 6,319,397 | B1 | 11/2001 | Su et al. | |
| 7,069,603 | B2 | 7/2006 | Flushing | |
| 7,458,109 | B1 * | 12/2008 | Kreisel | 4/252.1 |
| 7,621,002 | B1 | 11/2009 | Helmstetter et al. | |
| 7,934,516 | B1 | 5/2011 | Jaynes | |
| 2006/0059610 | A1 | 3/2006 | Conant | |
| 2011/0120504 | A1 | 5/2011 | Barkiak, Jr. | |

FOREIGN PATENT DOCUMENTS

| | | |
|---|---|---|
| CA | 2641833 | 8/2007 |

* cited by examiner

*Primary Examiner* — Huyen Le
(74) *Attorney, Agent, or Firm* — Richard D. Okimaw

(57) ABSTRACT

An apparatus for containing overflow water from a toilet comprises a base member having a central bore therethrough and an upwardly extending exterior wall extending around a periphery thereof and a sleeve extending through the central bore having a top end sized to be slidably received within a drain pipe for the toilet. The top end of the sleeve extends a riser distance above the base member so as to form an annular trap around the sleeve. The apparatus further comprises a top support extending substantially radially outwardly from the top end of the sleeve having openings around a periphery thereof so as to permit water introduced to a top surface of the base member to drain into the trap and a plurality of apertures extending through the sleeve proximate to the top support so as to drain water retained in the trap into the drain pipe for the toilet.

10 Claims, 7 Drawing Sheets

TOILET OVERFLOW PAN

BACKGROUND OF THE INVENTION

1. Field of Invention

The present invention relates to drains in general and in particular to an overflow pan for a toilet.

2. Description of Related Art

Toilets are a common fixture in most modern buildings. Toilets commonly include a tank for storing water and a bowl for receiving waste material. Typical toilets include a bend so as to retain a portion of water in the bowl as well as to prevent the escape of sewer gases. One common difficulty with conventional toilets is the potential of an overflow or other water leak condition. During such water leaks, water may be discharged from the toilet bowl onto the surrounding floor surface which is known to cause water damage to both the floor and surrounding objects.

Previous attempts to prevent water escaping from toilets have been unsatisfactory. In particular, water collection devices have been provided below the floor around the drain pipe to collect water dripped from a toilet discharge flow. Examples of such devices are illustrated in U.S. Pat. No. 7,934,516, issued May 3, 2011 to Jaynes. Disadvantageously, as such devices are located below the floor, installation of these devices must be completed either before completion of the floor or by removing the floor for retrofitting purposes.

Other attempts have been made to provide water collection drain pans around the base of the toilet. Such devices include a drain located therein for disposing of the collected water. Disadvantageously, such drains are required to penetrate the floor of the building to the drain pipe requiring additional holes be drilled in the floor. Examples of such devices are illustrated in US Patent Application Serial No. US 2011/0120504 to Barniak, J R.

SUMMARY OF THE INVENTION

According to a further embodiment of the present invention there is disclosed a apparatus for containing overflow water from a toilet. The apparatus comprises a base member having a central bore therethrough and an upwardly extending exterior wall extending around a periphery thereof. The apparatus further comprise a sleeve extending through the central bore having a top end sized to be slidably received within a drain pipe for the toilet. The top end of the sleeve extends a riser distance above the base member so as to form an annular trap around the sleeve. The apparatus further comprises a top support extending substantially radially outwardly from the top end of the sleeve having openings around a periphery thereof so as to permit water introduced to a top surface of the base member to drain into the trap and a plurality of apertures extending through the sleeve proximate to the top support so as to drain water retained in the trap into the drain pipe for the toilet.

The top support may be substantially planar. The top support may include a downturned portion therearound. The downturned portion may include the openings therethrough. The openings may be located proximate to the base member.

The base member may include a substantially horizontal portion proximate to the sleeve and an angularly oriented section therearound. The angled portion may include a plurality of alternating radially spaced apart raised portions. The horizontal portion may extend parallel to a floor surrounding the drain pipe. The angularly oriented portion may extend above a horizontal plane defined by the horizontal portion by an angle of between 5 and 30 degrees.

According to a further embodiment of the present invention there is disclosed a system for maintaining a toilet, the system comprising an apparatus for containing overflow water from a toilet. The apparatus comprises a base member having a central bore therethrough and an upwardly extending exterior wall extending around a periphery thereof. The apparatus further comprise a sleeve extending through the central bore having a top end sized to be slidably received within a drain pipe for the toilet. The top end of the sleeve extends a riser distance above the base member so as to form an annular trap around the sleeve. The apparatus further comprises a top support extending substantially radially outwardly from the top end of the sleeve having openings around a periphery thereof so as to permit water introduced to a top surface of the base member to drain into the trap and a plurality of apertures extending through the sleeve proximate to the top support so as to drain water retained in the trap into the drain pipe for the toilet. The system further comprises a cleaning tube having a valve therewith extending from a fill pipe for the toilet.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
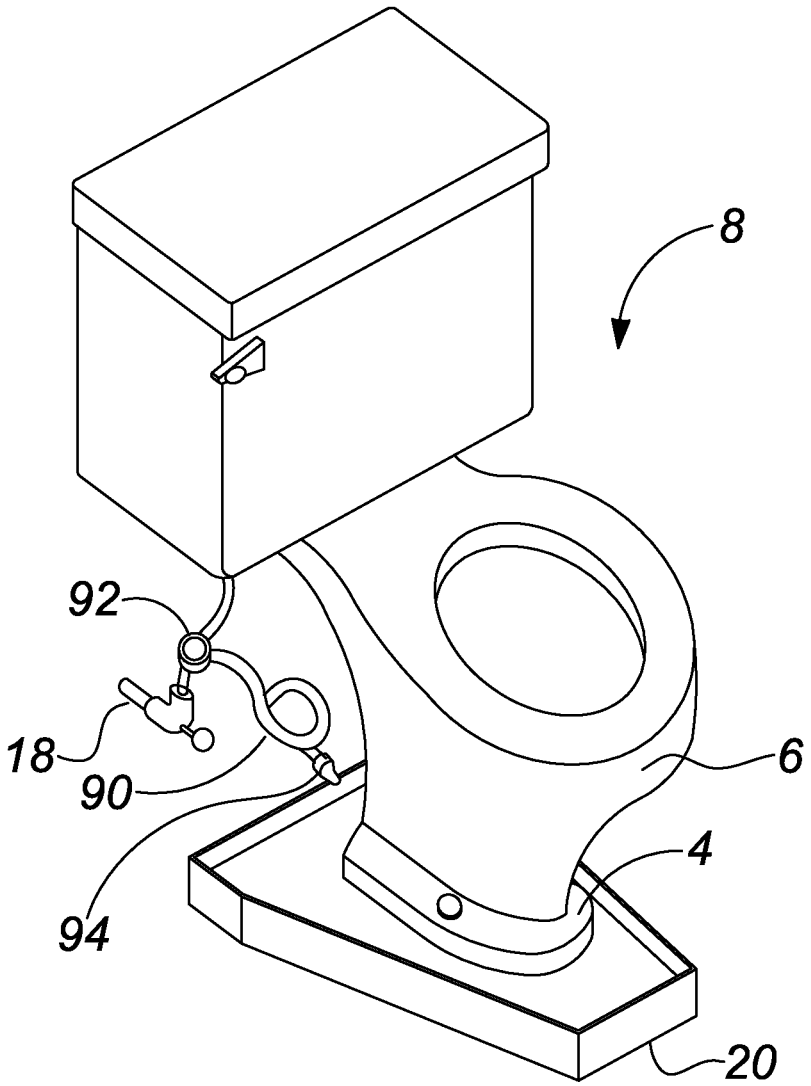
FIG. 1 is a perspective view of a toilet having an apparatus for catching overflow therefrom according to a first embodiment of the present invention applied thereunder.

Referring to FIG. 1, an apparatus for containing overflow water from a toilet 8 according to a first embodiment of the invention is shown generally at 20. As illustrated, the toilet 8 may be of a conventional design and includes a bowl portion 6 supported by a base 4. As illustrated, the apparatus 20 is located under a toilet 8 so as to surround the base 4.

Figure 2:
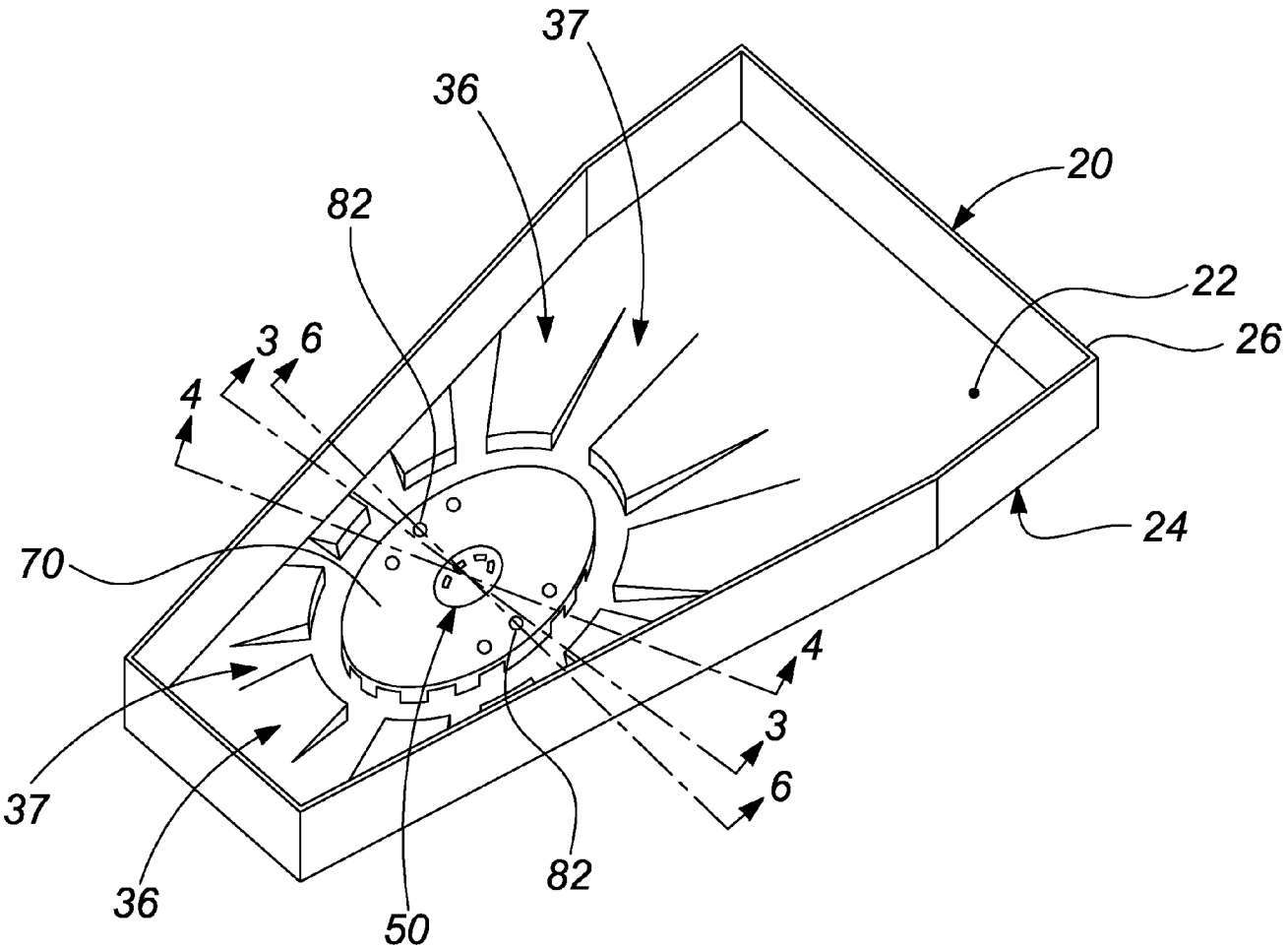
FIG. 2 is a perspective view of the apparatus of FIG. 1.

With reference to FIG. 2, the apparatus 20 comprises a base member 22 a sleeve 50 extending through the base member and a top support 70 extending radially therefrom. The base member 22 comprises a substantially planar member having an outer peripheral edge 24 and a central bore 34 therethrough. An optional upwardly extending exterior wall 26 extends from the peripheral edge 24 of the base member 22 so as to form a fluid holding body with the base member. The exterior wall is substantially perpendicular to a floor 14 when the apparatus is installed in a drain pipe 12 as illustrated in be selected in FIG. 3. The exterior wall may have any height as selected by a user so as to adequately contain an overflow of the toilet, although it has been found that a height of up to 2 inches (51 mm) has been found to be useful. The exterior wall 26 may be co-formed with or secured to the base member 22 by adhesives, fasteners or the like.

Figure 3:
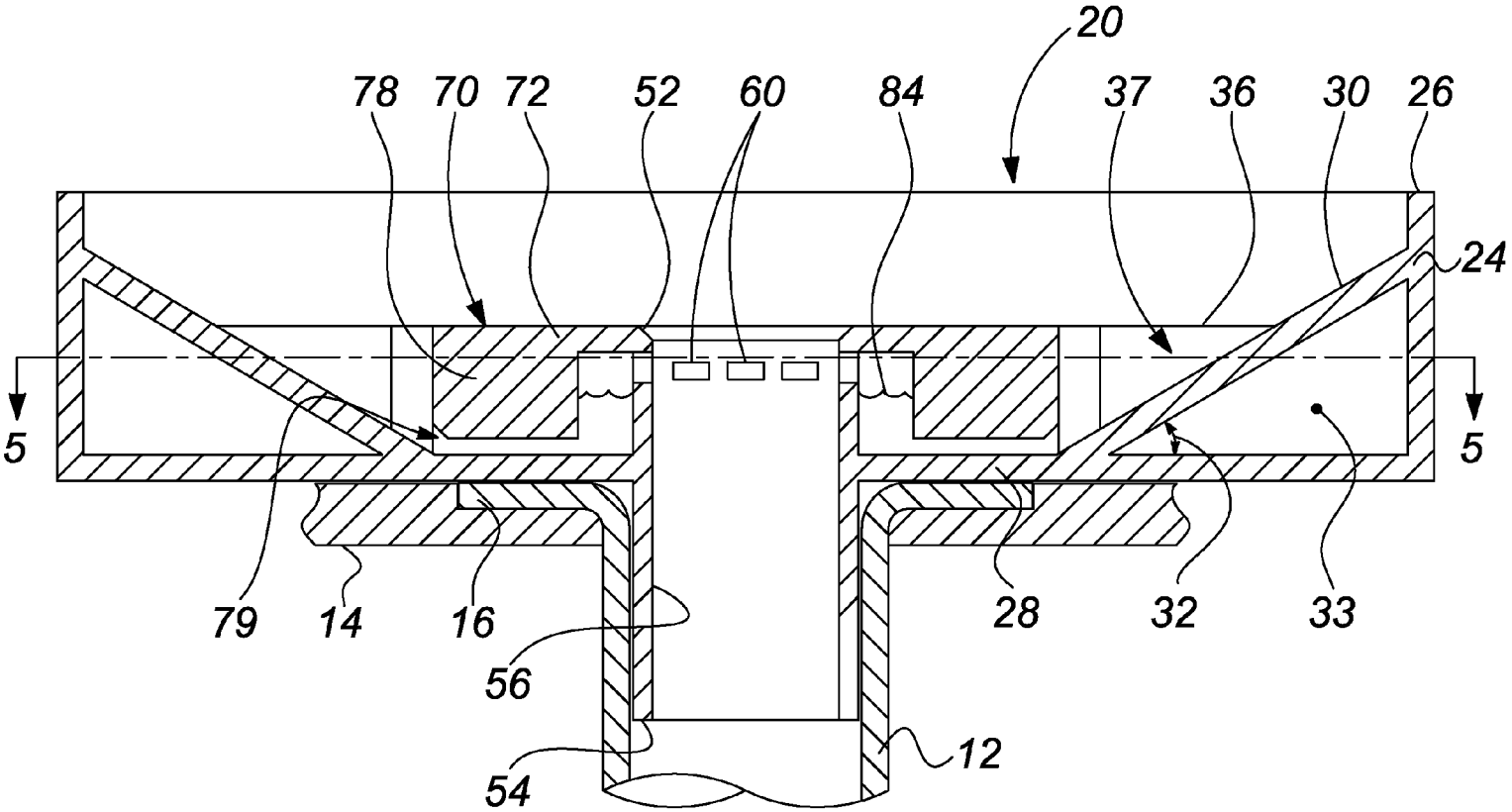
FIG. 3 is a cross sectional view of the apparatus of FIG. 1 as taken along line 3-3 in FIG. 2.
Figure 4:
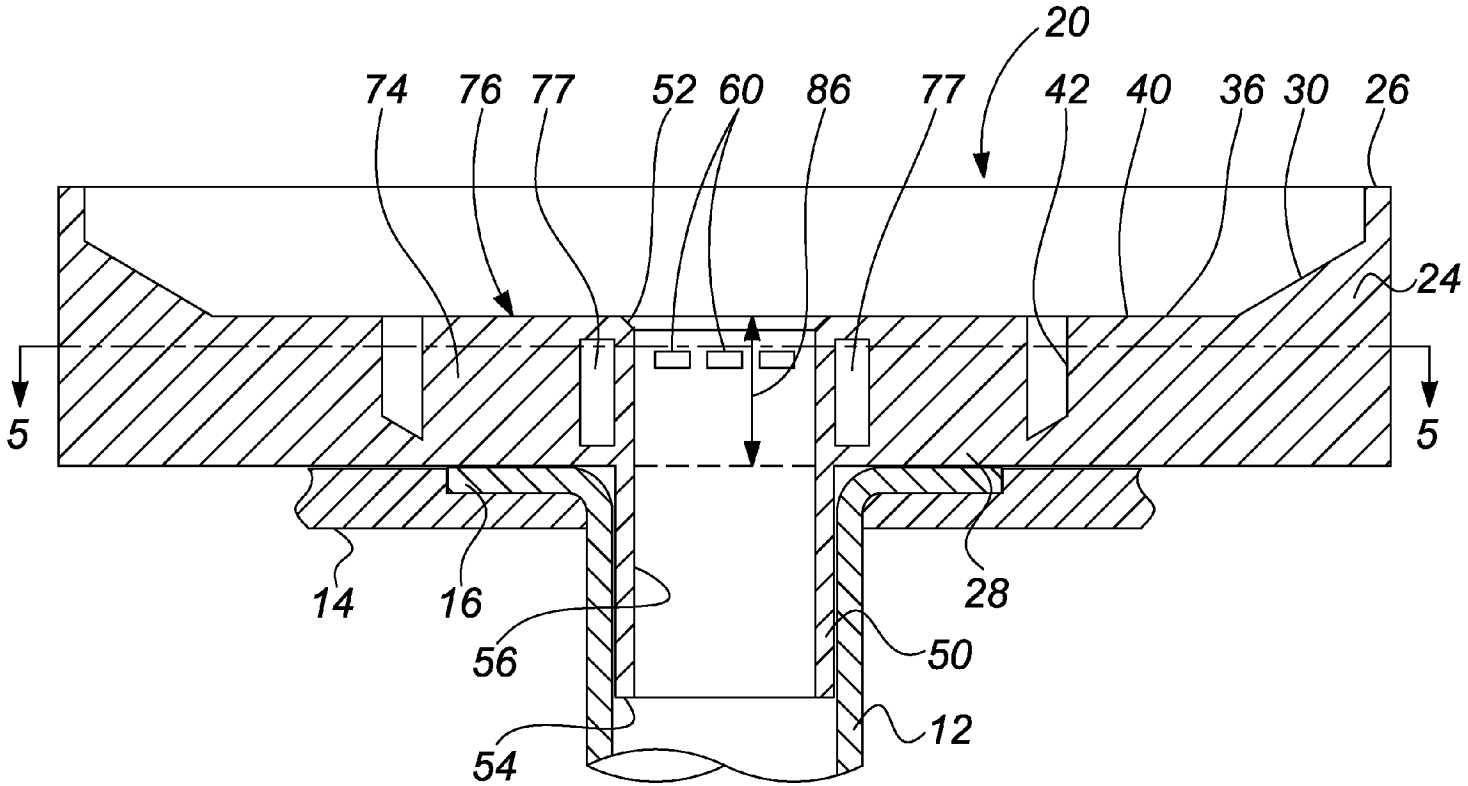
FIG. 4 is a cross-sectional view of the apparatus of FIG. 1 as taken along the line 4-4 in FIG. 2.
Figure 5:
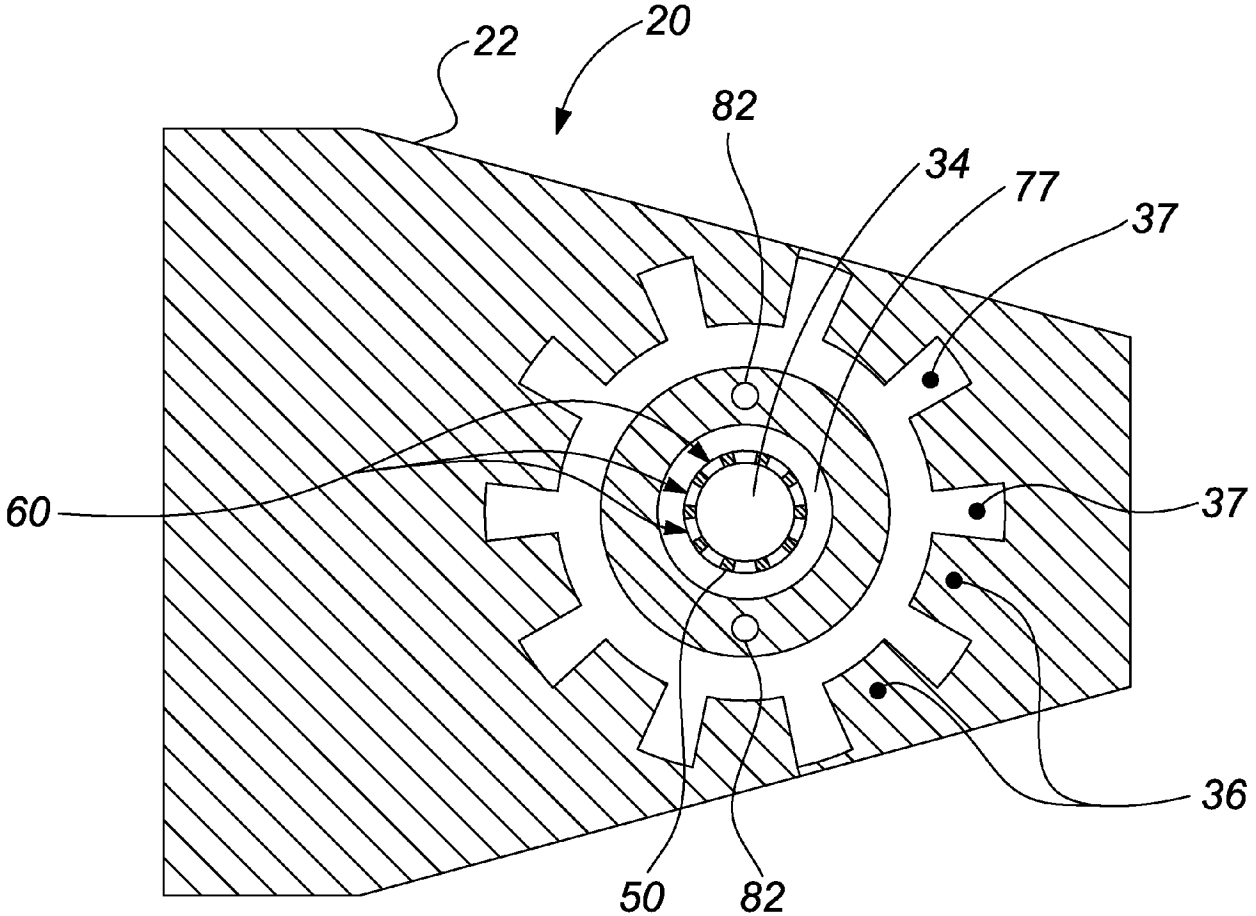
FIG. 5 is a cross sectional view of the apparatus of FIG. 1 as taken along line 5-5 in FIGS. 3 and 4.

With reference to FIGS. 3 and 4, the base member 22 may include a central substantially horizontal portion 28 and an angular portion 30 extending therearound. The angular portion 30 is angularly oriented relative to the horizontal portion by an inclination angle, generally indicated at 32. The inclination angle 32 assists with collecting any fluid introduced into the apparatus to the center thereof as will be more fully described below. As illustrated in FIG. 2, the base member 22 may have any shape as desired by a user, such as, by way of non-limiting example, square, oval, circular or irregular although it will be appreciated that for many toilets a substantially rectangular shape having a narrowed front portion corresponding approximately to the base 4 of the toilet will be useful. The size of the base member may be selected to be slightly larger than the toilet for which it is intended to be used, such as having a length of 30 inches (762 mm) and a width of 20 inches (508 mm) at the rear and 16 inches (406 mm) at the front. As illustrated in FIG. 2, the base member 22 includes a central bore 34 therethrough defined by the sleeve 50 as will be more fully described below. As illustrated in FIG. 4, the base member 22 may be solid under the inclined portion or may include a hollow section 33 thereunder as illustrated in FIG. 3.

The base member includes a raised outer portion 36 extending from a top surface 38 thereof. The raised outer portion 36 extends annularly around top support 70 as described further below and is defined by a substantially horizontal surface 40 and a substantially vertical surface 42 although it will be appreciated that other profiles may be useful as well. As illustrated in FIG. 2, the raised portion 36 includes alternating voids 37 extending radially from the sleeve 50 which assists with retaining water introduced into the base member proximate to the sleeve 50 as will be more fully described below. The raised portion 36 may be co-formed with or secured to the base member 22 by adhesives, fasteners or the like. The base member 22 may be formed of any suitable material, such as, by way of non-limiting example, plastic, metals, composite materials and the like.

With reference to FIGS. 3 and 4, the sleeve 50 extends through the central bore 34 of the base member. The sleeve 50 may be co-formed with the base member as illustrated or secured thereto by adhesives, fasteners or the like. The sleeve 50 comprises a substantially cylindrical member extending between top and bottom ends 52 and 54, respectively and having inner and outer surfaces 56 and 58, respectively. The central bore 34 and the sleeve 50 are selected to have a diameter such that the outer surface 58 of the sleeve is operable to be slidably and sealably received within a drain pipe 12. The sleeve 50 may be selected to have a length sufficient for the top end 52 of the to extend above the base member 22 as will be more fully described below as well as to extend the bottom end 54 into the drain pipe 12 by a distance sufficient to form an adequate seal therewith. In practice, it has been found that a sleeve length of between 2 and 6 inches (51 and 152 mm) has been useful although it will be appreciated that other lengths may be useful as well.

The sleeve 50 includes a plurality of apertures 60 located proximate to the top end 52 thereof. The apertures 60 may have any shape as desired by a user, such as, by way of non-limiting example, rectangular, circular, oval, square, triangular or irregular. As illustrated in FIG. 3, the apertures may be located proximate to the top support. The apertures 60 are radially arranged around the sleeve 50 and may be located to correspond substantially to the openings in the top support 70 as illustrated in FIG. 4 as will be further described below.

The top support 70 comprises substantially planar disk-shaped top member 72 having a plurality of alternating solid and hollow sections, 74 and 76, respectively extending radially around the sleeve 50. Each of the hollow sections includes an end wall 78 having a gap 79 thereunder. The top support 70 further includes an annular void 77 therearound so as to maintain each hollow section in fluidic communication with each other. The gap 79 permits water flowing down the angular portion 30 of the base member 22 to flow into the hollow sections 76 where such water forms a vapour trap therewith.

Figure 6:
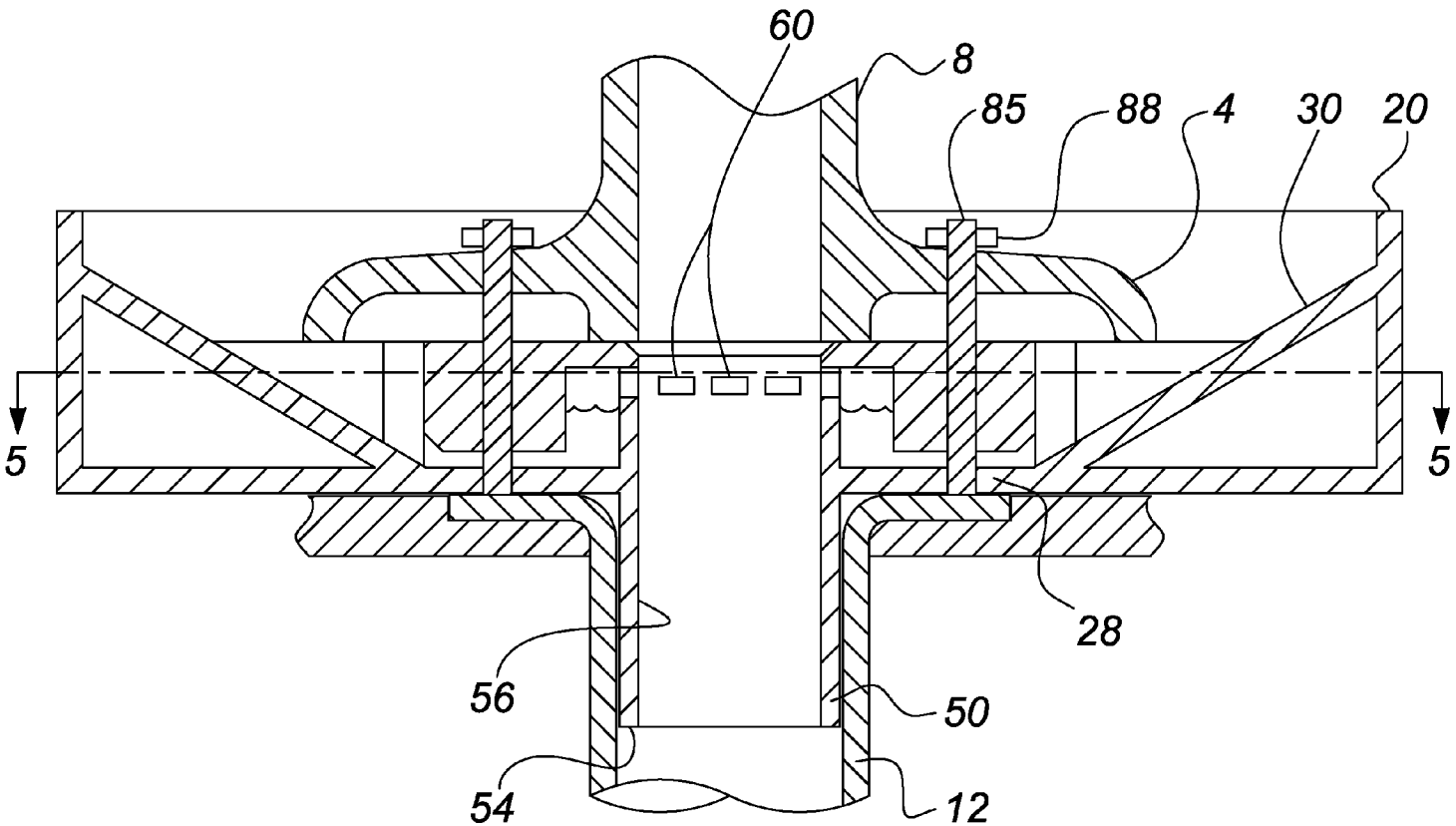
FIG. 6 is a cross sectional view of the apparatus of FIG. 1 as taken along line 6-6 in FIG. 2 with a toilet applied to a top thereof.

In operation, the apparatus 20 may be applied to a toilet drain with the sleeve 50 slidably and sealably located within the drain pipe 12 as illustrated in FIGS. 3 and 4. Thereafter a toilet 8 may be located thereover with the top support 70 supporting the toilet as illustrated in FIG. 6. Optionally a wax ring, as is conventionally known may be placed between the toilet 8 and the top support 70. As illustrated in FIG. 2, two of the fingers 72 may include bores 82 operable to pass toilet anchor bolts 85 therethrough so as to permit the toilet base 4 to be anchored to the drain flange 16 with nuts 88 or the like as are commonly known in the art.

After installation, a quantity of water may be introduced to the base member 22 which will then be collected within a trap between the sleeve 50 and the raised portions 36 below the apertures 60, generally indicated at 84. As illustrated, the sleeve 50 may extend above the base member 22 by a riser distance, generally indicated at 86 so as to locate the apertures 60 at a distance above the base member 22 to retain a desired quantity of water within the trap. It will be observed that the water located within the trap 84 prevents the escape of sewer gas from the drain pipe through the apparatus. In the event of an overflow condition, excess water may escape the toilet bowl 6 and run down the side of the toilet to the base 4 where it is collected by the base member 22. The base member 22 directs the water to the trap 84 along the angular portions 30 where it is retained until a sufficient quantity of water is introduced thereinto such that the water level in the trap reaches the apertures 60. Thereafter if any additional water is introduced to the trap 84, the apertures permit a corresponding volume to be drained therefrom into the drain pipe 12 through the apertures 60.

As illustrated in FIG. 1, optionally, the apparatus may include a cleaning tube 90 extending from fill line 18 for toilet 8. The cleaning tube 90 may include a valve 92 as are conventionally known so as to permit a user to selectably provide a water flow through the cleaning tube. The cleaning tube 90 may also include an end nozzle 94 as are conventionally known. The cleaning tube 90 may be of any conventional type, such as plastic, rubber or braided steel tubing. The cleaning tube 90 permits the user to spray or otherwise wash the apparatus periodically.

Figure 7:
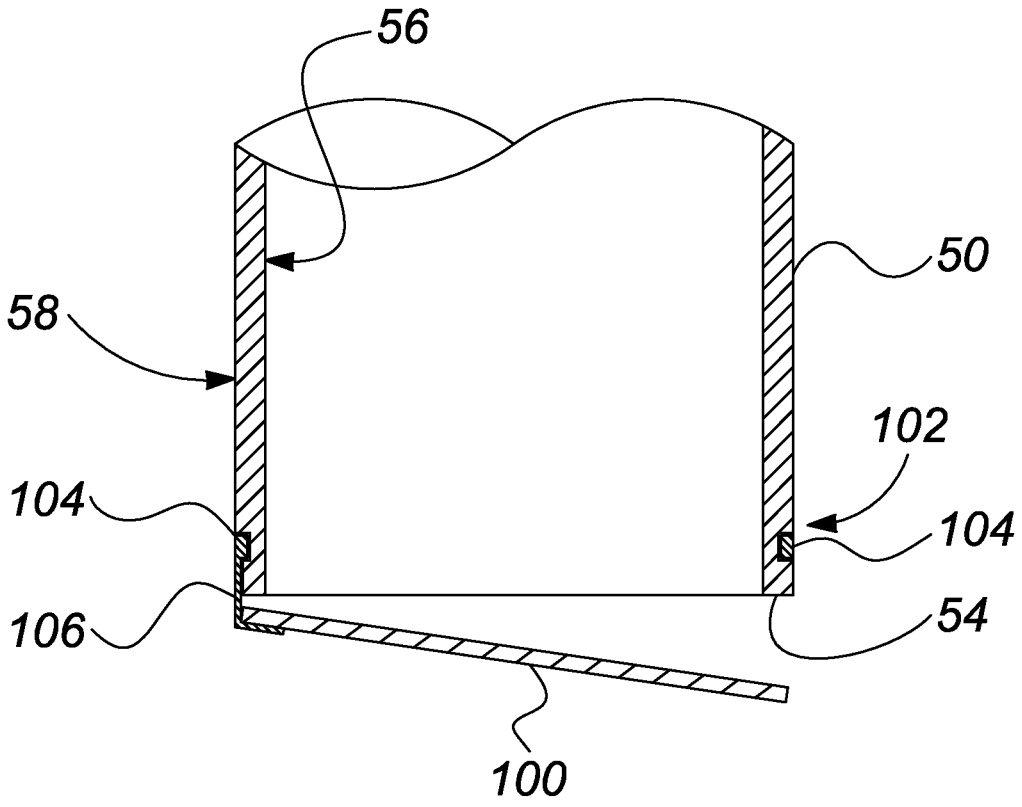
FIG. 7 is a detailed cross sectional view of the bottom end of the sleeve of apparatus of FIG. 1 having a backflow valve.

With reference to FIG. 7, optionally, the sleeve 50 may include a flap 100 located at the bottom end 54 thereof. The sleeve 50 may include an annular groove 102 extending therearound having a retaining ring 104 or other suitable structure therein. A flexible connector 106, such as, by way of non-limiting example, a band, spring or the like may connect the retaining ring 104 to the flap 100 so as to retain the flap proximate to the bottom end 54 of the sleeve 50. Under a backflow condition, the flap 100 will be urged upwards into contact with the bottom end of the sleeve. Optionally the flap 100 may also be biased into contact with the bottom end with a spring or the like.

While specific embodiments of the invention have been described and illustrated, such embodiments should be considered illustrative of the invention only and not as limiting the invention as construed in accordance with the accompanying claims.

What is claimed is:

1. An apparatus for containing overflow water from a toilet, the apparatus comprising:

a base member having a central bore therethrough and an upwardly extending exterior wall extending around a periphery thereof;

a sleeve extending through said central bore having a top end, said sleeve sized to be slidably received within a drain pipe for the toilet, said top end of said sleeve extending a riser distance above said base member so as to form an annular trap around said sleeve;

a top support extending substantially radially outwardly from said top end of said sleeve, said top support having openings around a periphery thereof so as to permit water introduced to a top surface of said base member to drain into said trap; and a plurality of apertures extending through said sleeve proximate to said top support so as to drain water retained in said trap into said drain pipe for the toilet.

2. The apparatus of claim 1 wherein said top support is substantially planar.

3. The apparatus of claim 2 wherein said top support includes a downturned portion therearound.

4. The apparatus of claim 3 wherein said downturned portion includes said openings therethrough.

5. The apparatus of claim 4 wherein said openings are located proximate to said base member.

6. The apparatus of claim 1 wherein said base member includes a substantially horizontal portion proximate to said sleeve and an angularly oriented section therearound.

7. The apparatus of claim 6 wherein said angled portion includes a plurality of alternating radially spaced apart raised portions.

8. The apparatus of claim 7 wherein said horizontal portion extends parallel to a floor surrounding said drain pipe.

9. The apparatus of claim 7 wherein said angularly oriented portion extends above a horizontal plane defined by said horizontal portion by an angle of between 5 and 30 degrees.

10. A system for maintaining a toilet, the system comprising an apparatus of claim 1 and a cleaning tube having a valve therewith extending from a fill pipe for the toilet.

* * * * *